US005152405A

United States Patent [19]

Schriner

[11] Patent Number: 5,152,405

[45] Date of Patent: Oct. 6, 1992

[54] NOTE PAD HOLDER AND NOTE DISPLAY

[75] Inventor: Michael J. Schriner, Rocky River, Ohio

[73] Assignee: Microvision, Inc., Westlake, Ohio

[21] Appl. No.: 641,537

[22] Filed: Jan. 15, 1991

[51] Int. Cl.[5] ..... B42F 7/10

[52] U.S. Cl. ..... 211/50; 206/214; 206/555

[58] Field of Search ..... 211/50, 13; 248/447, 248/450, 460, 461; 206/214, 224, 371, 460, 555

[56] References Cited

U.S. PATENT DOCUMENTS

| | | | |
|---|---|---|---|
| 654,841 | 7/1900 | Sabin-MacDonald | 248/461 X |
| 1,271,219 | 7/1918 | Pratt . | |
| 2,202,300 | 5/1940 | Posnack | 211/50 |
| 3,168,363 | 2/1965 | Moivsour | 248/461 |
| 3,232,397 | 2/1966 | McCoy | 206/555 X |
| 3,799,488 | 3/1974 | Sena | 248/452 |
| 3,977,744 | 8/1976 | DeWitt | 206/214 X |
| 4,460,146 | 7/1984 | Raggiotti | 248/456 |
| 4,483,505 | 11/1984 | Dalbo | 248/447 |
| 4,587,752 | 5/1986 | Swamy | 40/124 |
| 4,696,399 | 9/1987 | Windorski | 206/560 |
| 4,807,744 | 2/1989 | Chiou | 206/214 |
| 4,844,264 | 7/1989 | Deskiewicz, Jr. | 211/50 |
| 4,919,276 | 4/1990 | Kim et al. | 211/50 |
| 4,964,519 | 10/1990 | Sugarman et al. . | |
| 5,025,919 | 6/1991 | Brinker et al. | 206/224 X |

*Primary Examiner*—Robert W. Gibson, Jr.
*Assistant Examiner*—Korie H. Chan
*Attorney, Agent, or Firm*—Watts, Hoffmann, Fisher & Heinke Co.

[57] ABSTRACT

A note pad holder and note display bar is shown. It comprises a base having a front, a rear, and a deck member, the top of the deck member having means for retaining a block of postable, self-adherent notes, a note display bar, and bar support means pivoted to the base, the bar support means supporting the note display bar above the base when said support means is folded upwards to a substantially erect position.

15 Claims, 4 Drawing Sheets

NOTE PAD HOLDER AND NOTE DISPLAY

This invention relates to a tray for holding, dispensing and displaying notes from a stack thereof, and more particularly to such tray adapted for stack (block) of self-adherent postable notes in the nature of Post-It (a trademark of the Minnesota Mining and Manufacturing Company) notes. The Post-It notes have a narrow band of pressure-sensitive adhesive on the back of each sheet. In a stack (block) the top edge often is covered with a thin layer of adhesive helping to keep that edge from fanning out.

BACKGROUND OF THE INVENTION

Heretofore there have been upright display boards with slantwise projecting arms on which to secure notes in an overlapping accessible fashion, containers for a block of the instant self-adherent notes, foldable racks and stands for holding a card, a book or the like almost upright to facilitate the reading of same, folding artists' easels, music stands, desk organizers for holding note pads, erasers, pencils, etc., and tiltable stenographic notebook holders.

While these are useful items, none of them unite the dispensing-from-a-pad function for the instant self-adherent notes with means for their effective, immediate and convenient display of a reminder or message, as for example, near a telephone or workspace. The instant invention accomplishes that. It provides a compact "high flag" display, retains a reserve of the note paper for it that is immediately accessible, and even can have a provision for holding a marking instrument such as a pencil or pen. Thus, memoranda and reminders can be made timely and conveniently before memory crumbles.

BROAD STATEMENT OF THE INVENTION

The instant note pad holder and note display comprises:

the deck member having means for accessibly retaining at least one block of postable, self-adherent notes;

a note display bar for retaining and displaying one or more individual notes; and display bar support means pivoted to said base, the bar support means holding the note display bar above the base when the support means is folded upwardly to a substantially erect position.

BEST MODES FOR CARRYING OUT THE INVENTION

Figure 5:
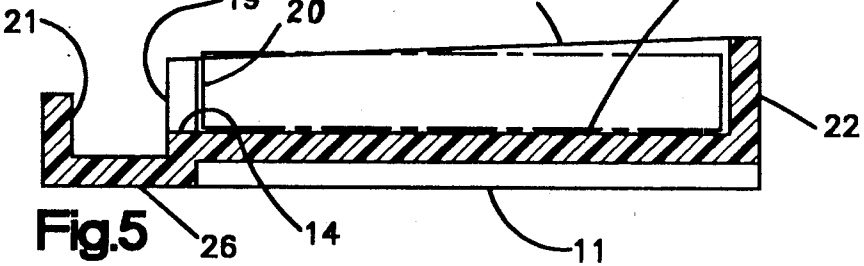
FIG. 5 is a cross-sectional elevation taken through Section 5-5 of FIG. 1.

Referring now to FIGS. 1–6, arrow 1 indicates generally the note pad holder and note display. The front of the base, a tray for a pencil or the like, is formed from front member 21 rising from projecting member 16. The inner rim 24, back wall 22, front abutments 19, notch 14, and bottom 16 form a well to hold a block of the self-adherent 3"×3" Post-It notes. The block 20 is indicated in dotted outline in FIGS. 5 and 6. The righthand vertical edge of block 20 in FIG. 5 is peelably adhered together to preclude fanning out; the front edge will tend to fan up a bit in use. Individual sheets, usually having a message written on them, are plucked from upper surface of the block with the thumb and forefinger, one's thumb generally riding over the notch 14.

Display bar 18 is integral with the supports 17, and the latter are pivoted to the base by pins 23. The article preferably is made of a molded polymer composition, i.e., base, display bar, and supports (and even the pins 23, if desired). The notes are stuck manually to the display bar, front and/or rear. If it is desired to collapse the display bar (as in FIG. 2) with the notes still adhering to it, the notes best are stuck only to the back of the bar and/or the side extensions of it. Normally the notes are removed as their message is returned or executed as the case may be.

The deck of the article is notched with notches 13 so that the supports 17 close flush with the remainder of the deck, i.e., the top of outer wall 12 and the inner rim 24. The display bar forms a cover over the pencil tray at the front. The bar can be made wider to rest on or over the front member 21, if desired.

Figure 1:
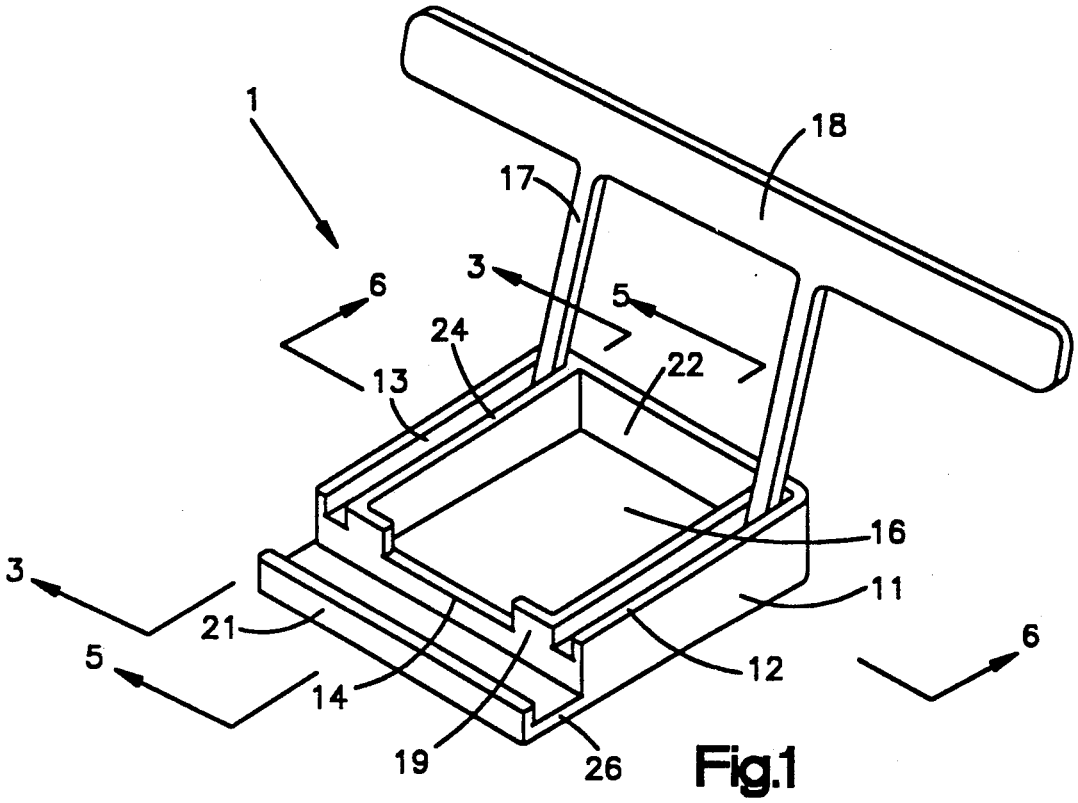
FIG. 1 is an isometric rendering of a preferred holder and display unit of this invention in "open" position, i.e., with the display bar up.
Figure 2:
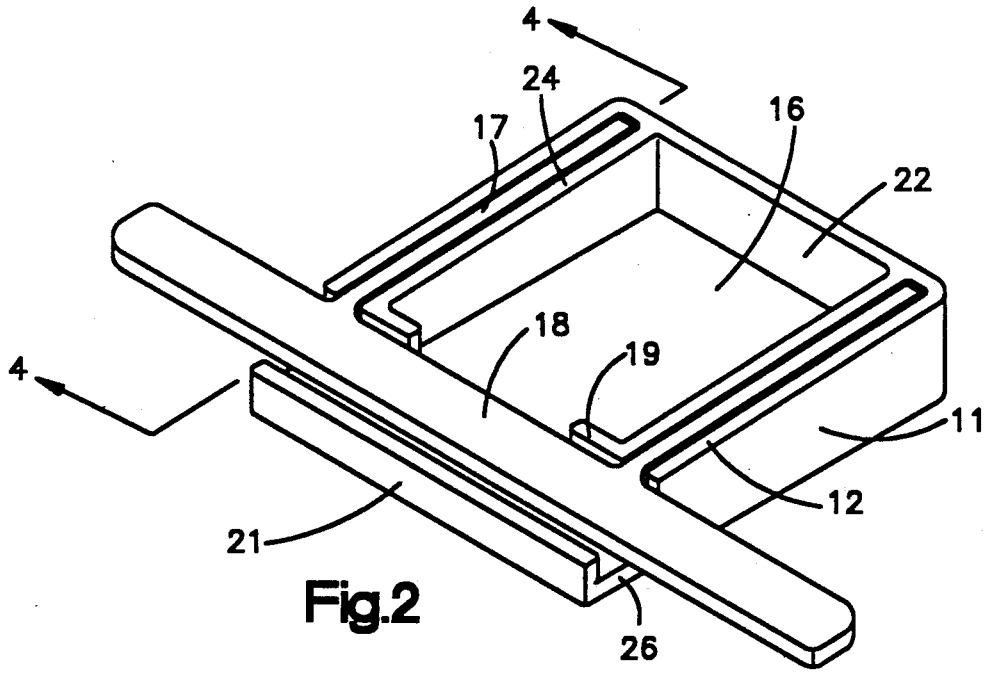
FIG. 2 is an isometric rendering of the same article, but in the "closed" position, i.e., with the display bar down.
Figure 6:
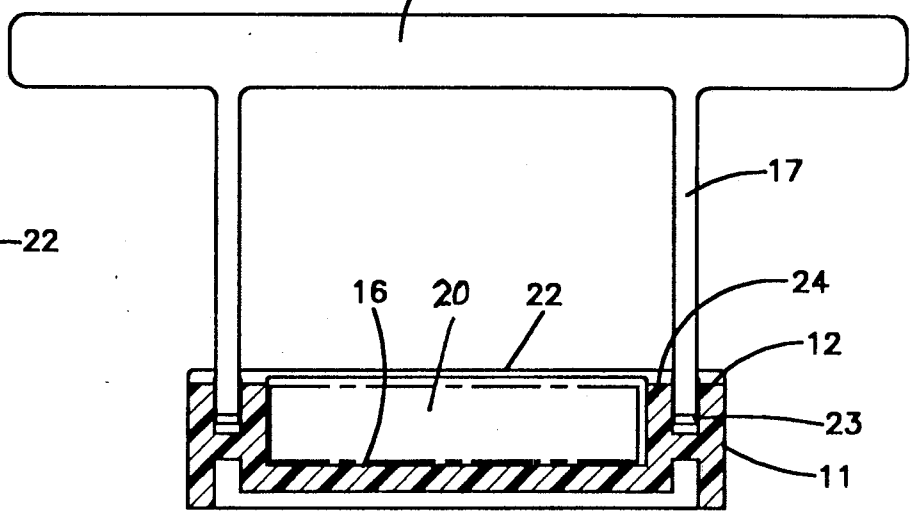
FIG. 6 is a cross-sectional elevation taken through Section 6—6 of FIG. 1.
Figure 3:
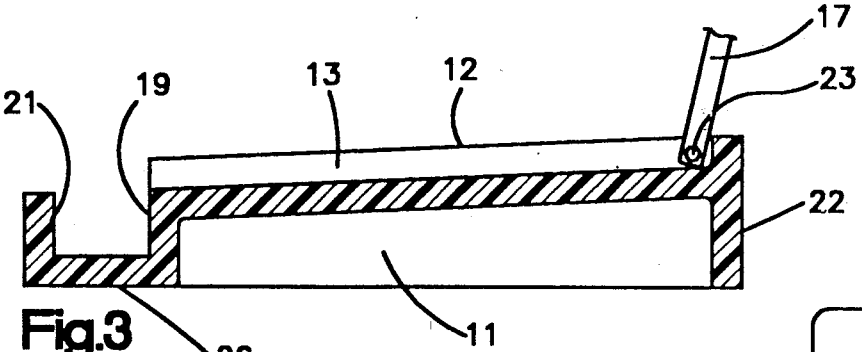
FIG. 3 is a cross-sectional elevation taken through Section 3—3 of FIG. 1.
Figure 4:
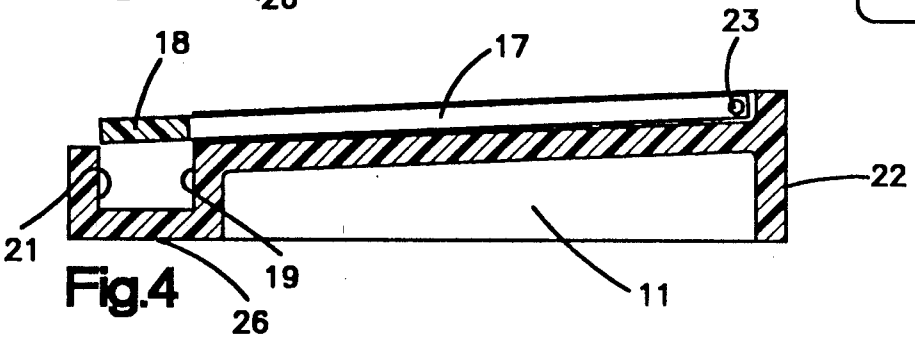
FIG. 4 is a cross-sectional elevation taken through Section 4—4 of FIG. 2.
Figure 7:
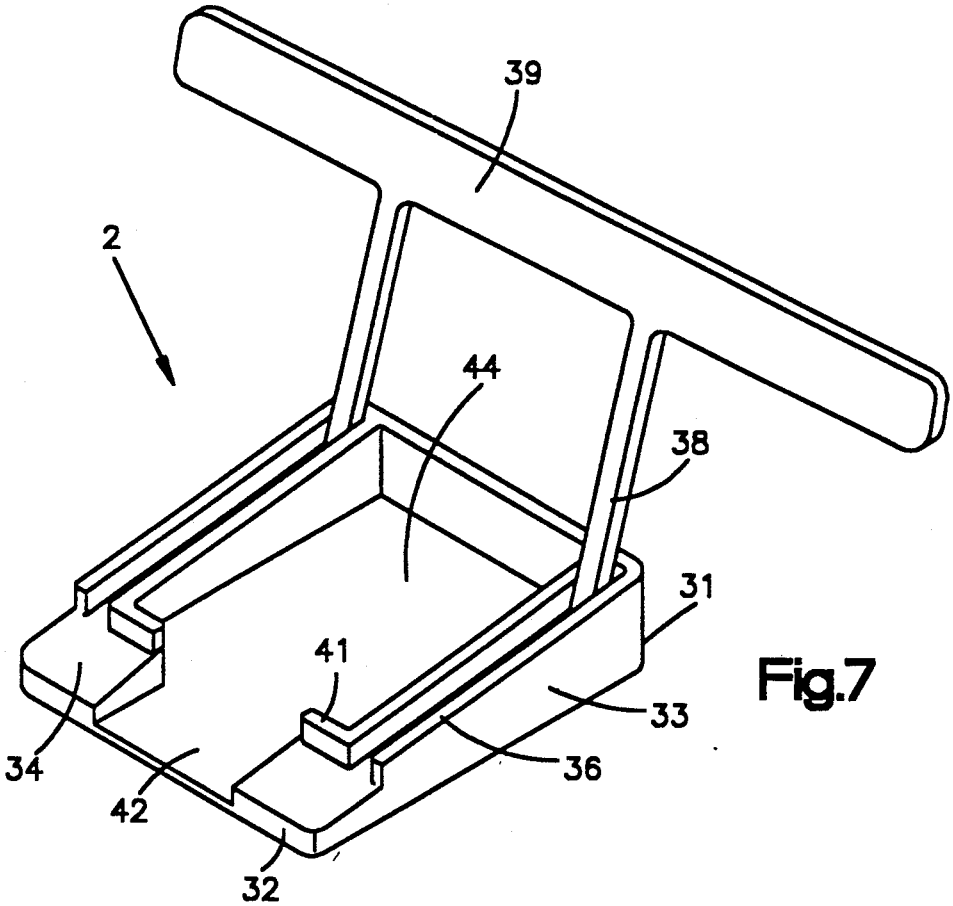
FIG. 7 is an isometric rendering of another preferred holder and display unit in the "open" position, this one without a tray for pencil or pen.
Figure 8:
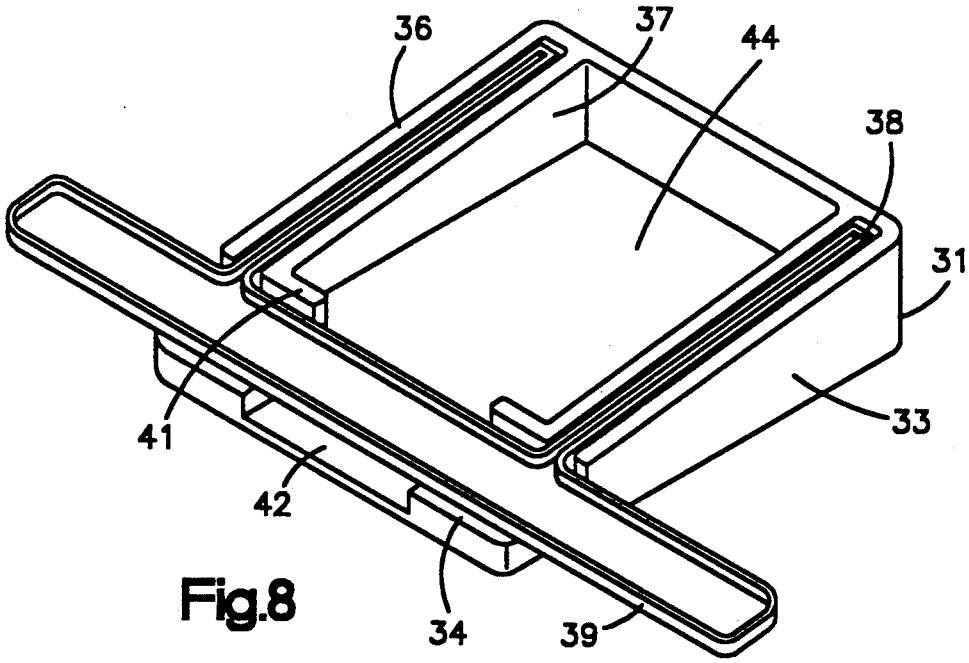
FIG. 8 is an isometric view of the article of FIG. 7, but in the "closed" position.

Referring to FIGS. 7 and 8, arrow 2 indicates generally a device quite similar to that of FIG. 1 except is has no pencil tray, the supports 38 and display bar 39 are hollowed out to make them lighter, and the bar 39, when closed down, rests on forward deck portions 32 and 34. The access notch 42 for plucking a self-adherent sheet from the note block (not shown) breaches the well 44 broadly from the front.

Figure 9:
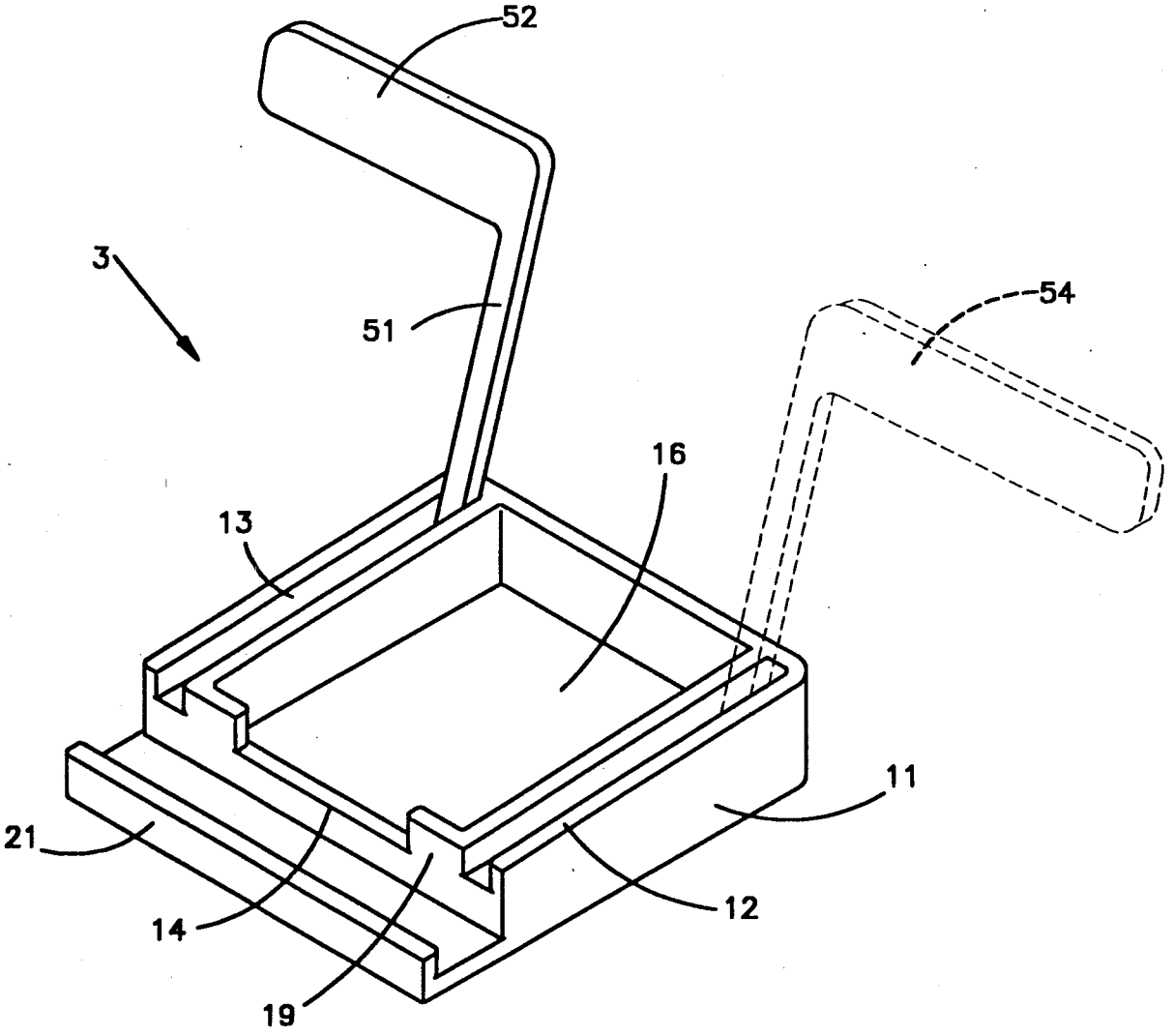
FIG. 9 is an isometric view of still another of the instant articles. There is a short display bar like a taximeter flag on the left side, and there can be one on the right also, if desired. The right side one is shown in dashed lines to indicate its being optional.

Referring to FIG. 9, arrow 3 indicates generally a note pad holder display device with a base like that in FIG. 1 and a small "high flag" note display bar 52 extending to the left of the base on support 51. If desired, the device can have the bar on the other side of the top, the support 51 can be pivoted from the outside of the base, and there can be yet an additional side display bar 54 extending to the right from support 53. (Items 53 and 54 are shown in dotted outline to indicate their being optional.) Also possible, of course, is to have the bar simply extend between supports 51 and 53 without substantial projection beyond the base edges.

The well in the article can be subdivided, as by septa not shown, to accommodate two or more blocks of the Post-It-type notes of the same or different sizes, or simply made large enough to hold the two or more blocks without appreciable lateral slip as the sheets are plucked. In any event, whether one or more blocks are accommodated, it is desirable that the well hold the blocks without appreciable such slip (i.e., firmly) for sheet-by-sheet extraction.

Many other modifications and variations of the invention will be apparent to those skilled in the art in the light of the foregoing disclosure and drawings. Therefore, it is to be understood that, within the scope of the appended claims, the invention can be practiced otherwise than has been specifically shown or described.

What is claimed is:

1. A note pad holder and note display comprising:

a base having a front, a rear, sides, and a deck member sloping from said rear to said front, the deck member having a well that is disposed to hold accessibly a block of postable, self-adherent notes;

a substantially horizontal note display bar that extends outward of each side of the base; and a pair of supports for said display bar, said supports being pivotally connected to the base near the rear thereof and wherein said display bar is held above the base when the supports are pivoted to an upward position.

2. The note pad hold of claim 1 including channels in the deck wherein said supports fold into channels in the deck and bracket the well, and the display bar lies forward of the well when said bar is folded down.

3. The note pad holder of claim 2 wherein the back of the display bar and the backs of said supports are flush with the deck when said bar is folded down.

4. The note pad holder of claim 3 wherein the front of said base includes a pencil-retaining groove extending across a forward part of the base, and a rear of said groove is notched for providing access to the well.

5. The note pad holder of claim 3 wherein the front of said base is notched for providing access to the well.

6. In combination, a note pad holder, note display and block of postable, self-adherent notes comprising:

a base having a front, a rear, and a deck member, the deck member having means for accessibly retaining a block of postable, self-adherent notes;

a block of said notes held by the deck member;

a note display bar for retaining and displaying one or more individual notes; and display bar support means pivoted to said base, wherein the bar support means holds the note display bar above the base when the support means is pivoted to a substantially erect position.

7. The combination of claim 6 wherein the base has sides, the deck member has a breach-front well disposed to hold the block of notes, the display bar extends outward of each side of the base, and there are a pair of supports for the display bar, said supports being pivotally connected to the base near the rear thereof and holding the display bar above the base when the supports are folded upwardly.

8. The combination of claim 7 including channels in the deck wherein said supports fold into channels in the deck and bracket the well, and the display bar lies forward of the well when said bar is folded down.

9. The combination of claim 8 wherein said supports include backs and a back of the display bar and the backs of said supports are flush with the deck member when said bar is folded down.

10. The combination of claim 9 wherein the front of the base includes a pencil-retaining groove extending across a forward part of a base, and the rear of said groove is notched for providing access to the paper in the well.

11. The combination of claim 9 wherein the front of the base is notched for providing access to the well.

12. A note pad holder and note display comprising:

a base having a front, a rear and a deck member, the deck member having space for accessibly retaining at least one block of postable, self-adherent notes;

note display bar means for retaining and displaying one or more individual notes, said bar means including individual right and left note display bars, and having a display position and a storage position; and, display bar support means including right and left display bar support means pivotably connected to said base, whereby said right and left note display bars are pivotably connected to said base by said right and left display bar support means respectively and displays said one or more notes when pivoted in said display position.

13. A note pad holder according to claim 12, including channels in the deck, wherein said supports fold into said channels in the deck and bracket the well, and the display bar means lie forward of said space.

14. A note pad holder according to claim 12, including backs of said supports, wherein a back of said display bar means and said backs of said supports are flush with the deck member when said bar is in the storage position.

15. A note pad holder according to claim 12, wherein the front of the base includes a pencil support extending across a forward part of the base, and the rear of said support is notched for providing access to the notes in the well.

* * * * *